US009804533B2

(12) United States Patent
Yamashita et al.

(10) Patent No.: US 9,804,533 B2
(45) Date of Patent: Oct. 31, 2017

(54) IMAGE FORMING APPARATUS

(71) Applicants: Takeshi Yamashita, Osaka (JP); Mitsutoshi Kichise, Osaka (JP)

(72) Inventors: Takeshi Yamashita, Osaka (JP); Mitsutoshi Kichise, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/220,818

(22) Filed: Jul. 27, 2016

(65) Prior Publication Data

US 2017/0031273 A1 Feb. 2, 2017

(30) Foreign Application Priority Data

Jul. 31, 2015 (JP) ..... 2015-152592

(51) Int. Cl.
*G03G 15/08* (2006.01)
*G03G 15/16* (2006.01)

(52) U.S. Cl.
CPC ..... *G03G 15/0898* (2013.01); *G03G 15/1605* (2013.01)

(58) Field of Classification Search
None
See application file for complete search history.

(56) References Cited

U.S. PATENT DOCUMENTS

2002/0047887 A1* 4/2002 Koga ..... B41J 2/395 347/141
2007/0092818 A1* 4/2007 Mizuhata ..... G03G 9/0832 430/108.1
2008/0131162 A1 6/2008 Nakatake et al.
2009/0014288 A1 1/2009 Miyazaki et al.
2009/0016772 A1 1/2009 Adachi et al.
2010/0239334 A1 9/2010 Iwami et al.
2011/0200353 A1* 8/2011 Kubo ..... G03G 15/0898 399/103
2013/0011158 A1 1/2013 Meguro et al.
2013/0236217 A1 9/2013 Nagatomo et al.
2014/0023388 A1* 1/2014 Yoshida ..... G03G 15/14 399/66
2015/0003852 A1 1/2015 Yamashita et al.
2015/0035928 A1 2/2015 Nakamura et al.
(Continued)

FOREIGN PATENT DOCUMENTS

JP 2007-011014 1/2007
JP 2011-158887 8/2011
JP 2015-044398 3/2015

*Primary Examiner* — Thomas Giampaolo, II
(74) *Attorney, Agent, or Firm* — Oblon, McClelland, Maier & Neustadt, L.L.P.

(57) ABSTRACT

An image forming apparatus including an image bearer to bear toner; a developer bearer includes a first seal on one end of the developer bearer in a direction of axis and a second seal on another end of the developer bearer in the direction of axis, to supply the image bearer with the toner; a supply member disposed within a range between the first seal and the second seal in the direction of axis, to supply the developer bearer with the toner; and a transfer member opposed to the image bearer. The transfer member has a width shorter than a width of the supply member in the direction of axis. The transfer member is disposed within a range between one end and another end of the supply member in the direction of axis.

7 Claims, 9 Drawing Sheets

(56) References Cited

U.S. PATENT DOCUMENTS

| | | | |
|---|---|---|---|
| 2015/0117901 | A1 | 4/2015 | Kichise et al. |
| 2016/0004205 | A1 | 1/2016 | Kichise |
| 2016/0033924 | A1 | 2/2016 | Fukao et al. |

* cited by examiner

IMAGE FORMING APPARATUS

CROSS-REFERENCE TO RELATED APPLICATION

This patent application is based on and claims priority pursuant to 35 U.S.C. §119(a) to Japanese Patent Application No. 2015-152592, filed on Jul. 31, 2015, in the Japan Patent Office, the entire disclosure of which is hereby incorporated by reference herein.

BACKGROUND

Technical Field

Exemplary aspects of the present disclosure generally relate to an image forming apparatus, such as a copier, a facsimile machine, a printer, or a multi-functional system including a combination thereof.

Related Art

In an image forming apparatus that employs toner as a developer, a supply member supplies a developer bearer with toner, and the toner is then supplied onto an image bearer, developing a latent image formed on the image bearer with the supplied toner. The developed toner image is primarily transferred onto a transfer member opposed to the image bearer, and the toner image is transferred onto a recording medium conveyed by the transfer member.

The developer bearer has seals on the ends of the developer bearer in the direction of axis to prevent toner from leaking out of the ends.

In such a configuration, an external additive separated from toner is likely to accumulate on the ends of the developer bearer, and the accumulated external additive is developed onto the image bearer during a developing process, resulting in the external additive aggregation (which is called as "killfish") appearing on the image bearer. With an increase in size of the external additive aggregation, the edge of the cleaning blade may be damaged, thereby causing toner to leak out of the damaged part, contaminating a charging roller, resulting in scattering of toner because the surface of the photoconductor corresponding to a contaminated position on the charging roller is not charged while toner continues to be developed.

SUMMARY

In an aspect of this disclosure, there is provided an image forming apparatus including an image bearer to bear toner; a developer bearer including a first seal on one end of the developer bearer in a direction of axis and a second seal on another end of the developer bearer in the direction of axis, to supply the image bearer with the toner; a supply member disposed within a range between the first seal and the second seal in the direction of axis, to supply the developer bearer with the toner; and a transfer member opposed to the image bearer. The transfer member has a width shorter than a width of the supply member in the direction of axis. The transfer member is disposed within a range between one end and another end of the supply member in the direction of axis.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
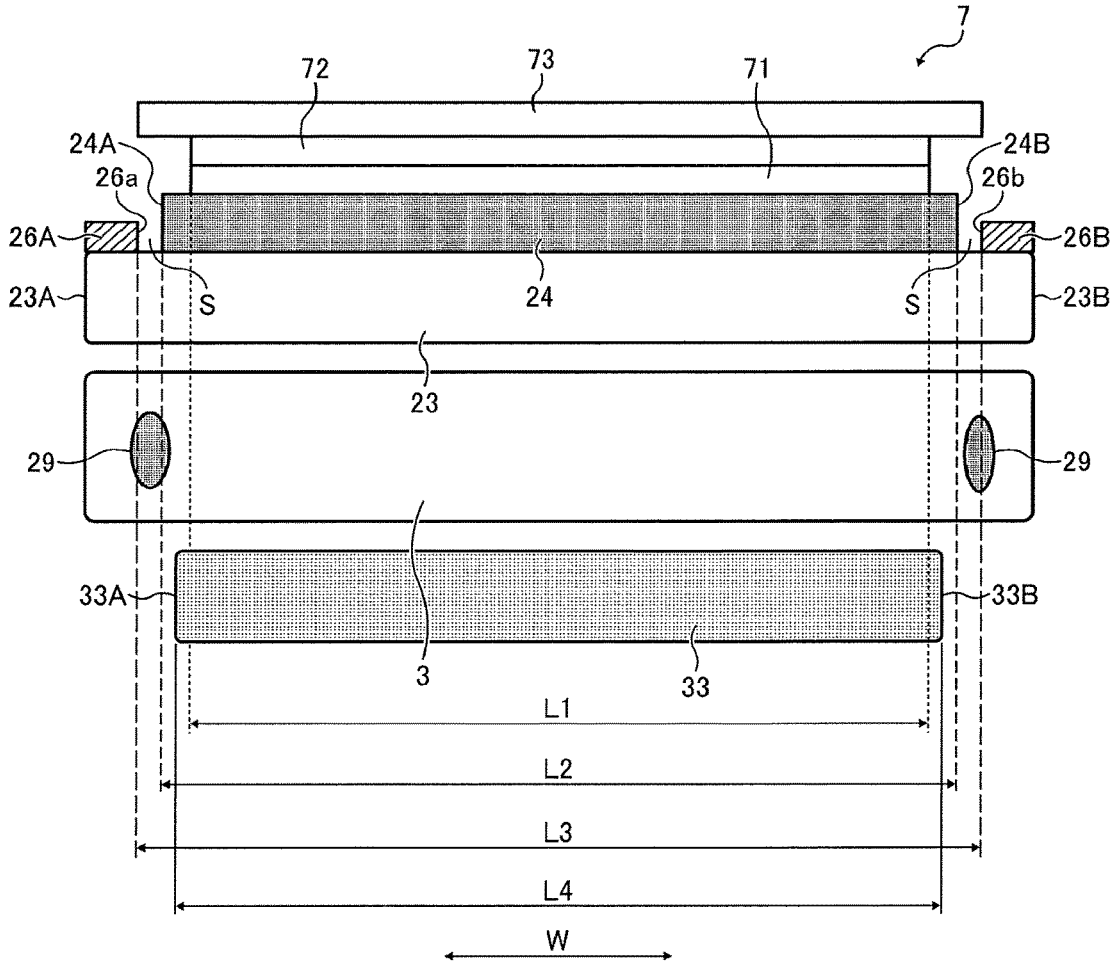
FIG. 1 is a diagram describing the relative positions of a supply member and a roller-shaped transfer member according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Referring to FIG. 1, a description is provided of an image forming apparatus 1/1A according to an embodiment of the present disclosure. In this case, the reference number "1" denotes a monochrome image forming apparatus, and the reference number "1A" denotes a color image forming apparatus. The same reference numerals will be given to constituent elements such as parts and materials having the same functions, and the descriptions thereof will be omitted. In some Figures, portions of configurations are partially omitted to better understand the configurations. It is to be noted that suffixes Y, M, C, and K denote colors yellow, magenta, cyan, and black, respectively. These suffixes may be omitted unless otherwise specified.

In the image forming apparatus 1/1A according to the present embodiment, disposing a transfer member within the width of a supply member in the direction of axis prevents scattering of toner. The supply member supplies a developer bearer with toner.

A description is first provided of the entire configuration of the image forming apparatus 1/1A, and then a description of configuration of characteristic portions is given.

Figure 2:
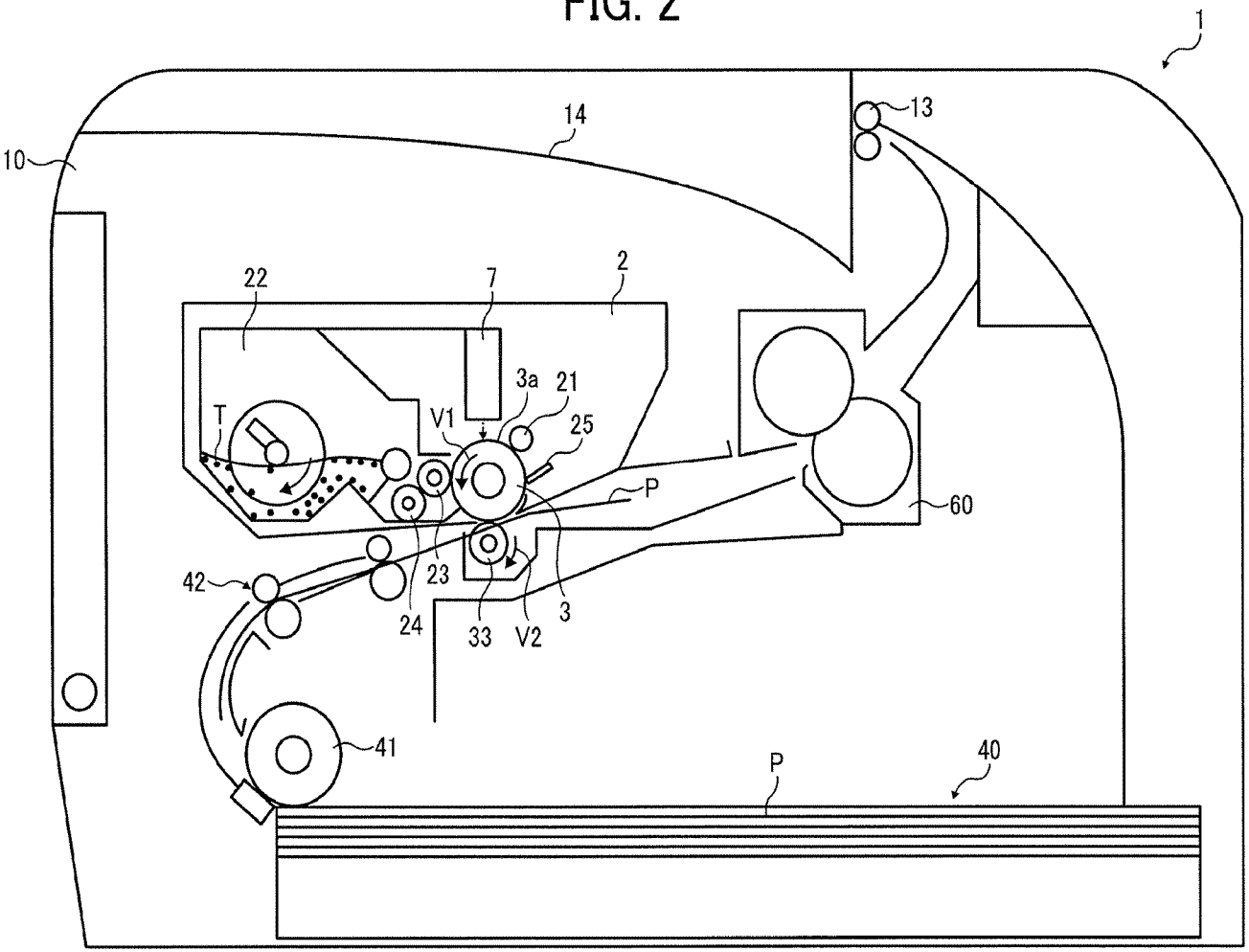
FIG. 2 is a schematic view of a monochrome image forming apparatus according to an embodiment of the present disclosure.
Figure 4A:
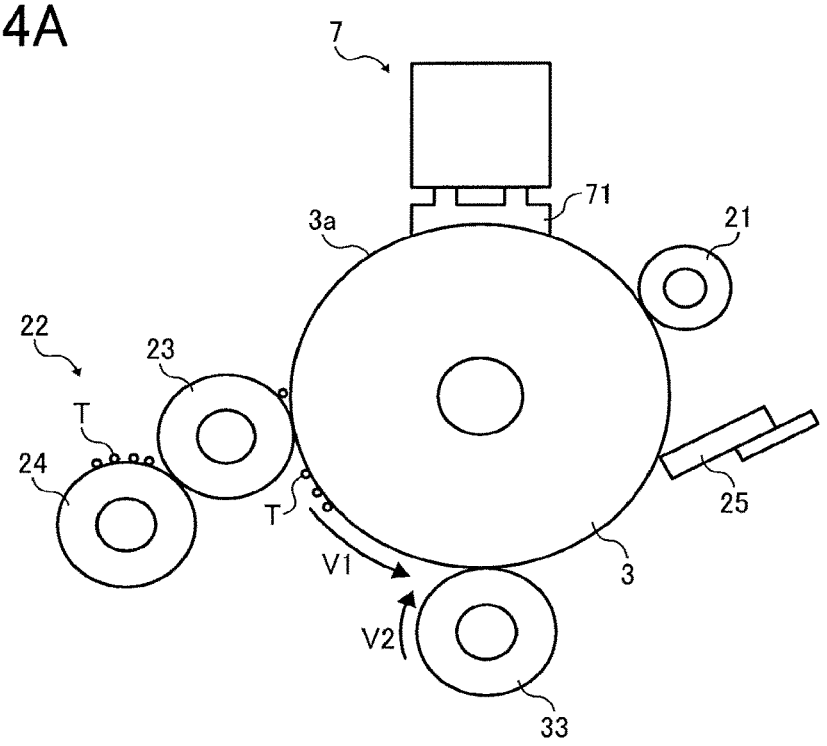
FIGS. 4A and 4B are schematic views of surroundings of an image bearer.

The image forming apparatus 1 illustrated in FIG. 2 is an electrophotographic monochrome image forming apparatus 1. In FIG. 2, the monochrome image forming apparatus 1 includes a process cartridge 2 in the center of an apparatus body 10. The process cartridge 2 includes a drum-shaped photoconductor 3 as an image bearer and an optical writing head 7 as an exposure unit. The photoconductor 3 rotates at a peripheral speed V1 within a predetermined range. The optical writing head 7 forms a latent image on the photoconductor 3. As illustrated in FIG. 4A, the process cartridge 2 includes, in a direction of rotation of the photoconductor 3, a developing roller 23 as a developer bearer used in the electrophotographic method, a cleaning blade 25 as a cleaner that constitutes a cleaning unit, a charging roller 21 as a charger that constitutes a charging unit, and the optical writing head 7. Between the optical writing head 7 and the photoconductor 3, a spacer 71 is disposed to determine the distance between the photoconductor 3 and the optical writing head 7. The developing roller 23 is supplied with toner T by a supply roller 24 as a supply member. The photoconductor 3 is supplied with toner T by the developing roller 23. The developing roller 23 and the supply roller 24 constitute the developing unit 22.

As illustrated in FIG. 2, below the process cartridge 2 is a transfer roller 33 as a roller-shaped transfer member contacting the photoconductor 3 to form a transfer portion between the transfer roller 33 and the photoconductor 3. A transfer bias is applied to the transfer roller 33. The transfer roller 33 rotates at a peripheral speed V2. A difference in peripheral speed occurs between the peripheral speed V1 of the photoconductor 3 and the peripheral speed V2 of the transfer roller 33. In the present embodiment, the peripheral speed V1 is greater than the peripheral speed V2.

Below the transfer roller 33, a sheet feeder 40 is disposed to include a cassette, in which recording sheets P are stacked and stored. The sheet feeder 40 feeds a recording sheet P toward the transfer portion, using a feed roller 41. The recording sheet P fed by the sheet feeder 40 is then delivered toward the transfer portion in appropriate timing by a registration roller 42. The registration roller 42 is disposed between the sheet feeder 40 and the transfer portion.

As illustrated in FIG. 4A, the photoconductor 3 bears a toner image on the surface 3*a* of the photoconductor 3. Such a toner image is obtained by developing a latent image written by the optical writing head 7 with the toner T supplied from the developing unit 22. Such a toner image is then transferred onto a recording sheet P fed from the sheet feeder 40 to the transfer portion.

As illustrated in FIG. 2, on the right side of the process cartridge 2 is disposed a fixing device 60. The recording sheet P having the toner image transferred onto at the transfer portion is delivered to the fixing device 60, and heat and pressure are applied to the recording sheet P. Accordingly, the toner image is melted and fixed on the recording sheet P in a fixing process. Then, the recording sheet P having the toner image fixed onto is discharged by ejection rollers 13 to a tray 14 on an upper face of the apparatus body 10.

Figure 3:
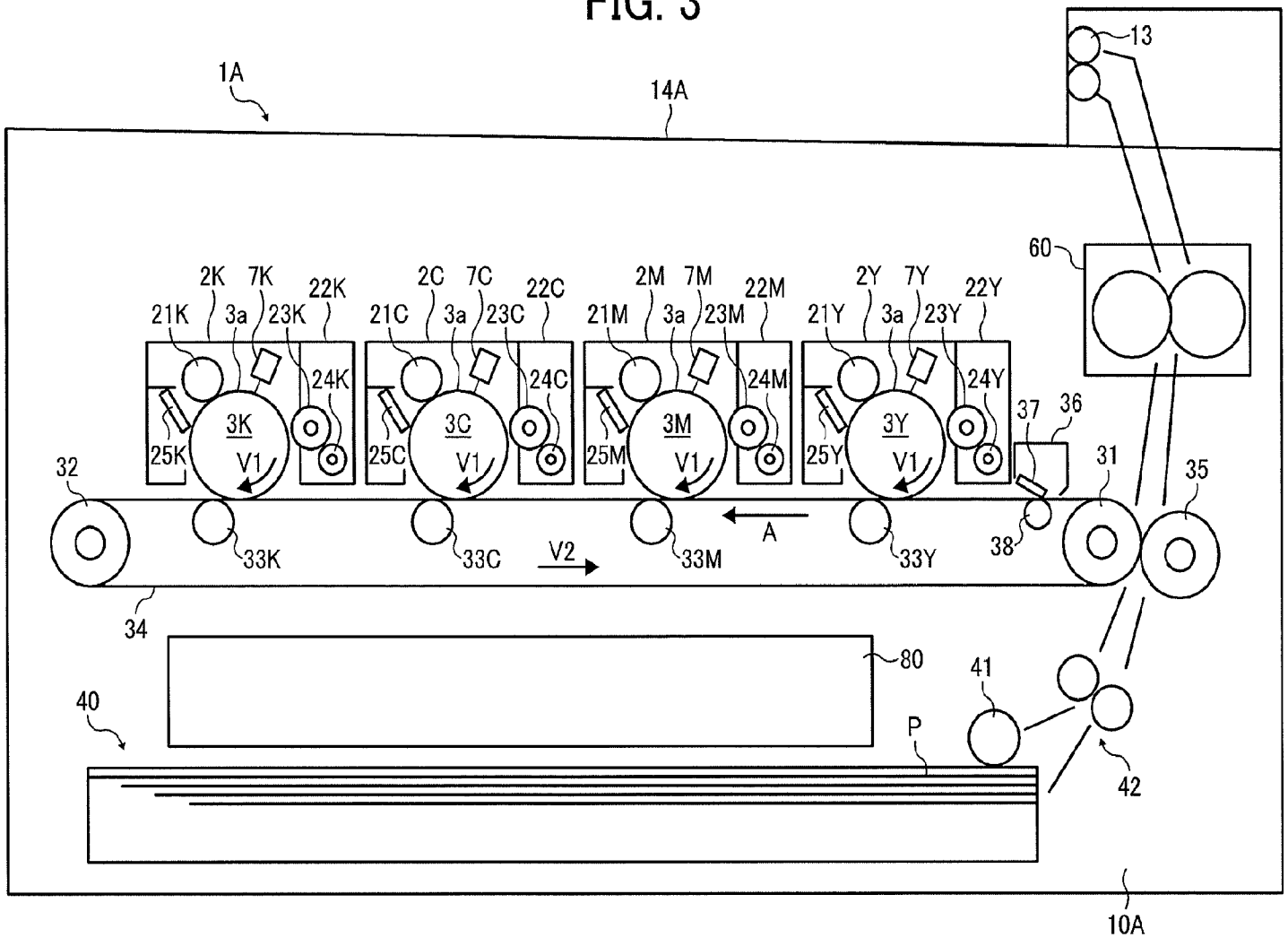
FIG. 3 is a schematic view of a multi-color image forming apparatus according to another embodiment of the present disclosure.

The image forming apparatus 1A illustrated in FIG. 3 is an electrophotographic color image forming apparatus 1A. The color image forming apparatus 1A according to the present embodiment includes a plurality of process cartridges 2Y, 2M, 2C, and 2K for the respective colors of yellow, magenta, cyan, and black in an apparatus body 10A. The color image forming apparatus 1A further includes an intermediate transfer device 30 as a transfer device, a sheet feeder 40, and a fixing device 60. The process cartridges 2Y, 2M, 2C, and 2K include drum-shaped photoconductors 3Y, 3M, 3C, and 3K, respectively. The photoconductors 3Y, 3M, 3C, and 3K serve as image bearers. The process cartridges 2Y, 2M, 2C, and 2K further respectively include charging rollers 21Y, 21M, 21C, and 21K as chargers, each constituting a charging unit, developing units 22Y, 22M, 22C, and 22K, cleaning blades 25Y, 25M, 25C, and 25K as cleaners, each constituting a cleaning unit, and a electric charge remover. Optical writing heads 7Y, 7M, 7C, and 7K are disposed between the charging rollers 21Y, 21M, 21C, and 21K and the developing units 22Y, 22M, 22C, and 22K, respectively, as optical writing devices to scan the respective photoconductors 3Y, 3M, 3C, and 3K while emitting exposure light to the respective photoconductors 3Y, 3M, 3C, and 3K. As the optical writing device, instead of disposing the optical writing heads 7Y, 7M, 7C, and 7K in the process cartridges 2Y, 2M, 2C, and 2K, respectively, the photoconductors 3Y, 3M, 3C, and 3K may be illuminated with a plurality of exposure light beams using a polygon mirror to perform scanning.

As illustrated in FIG. 3, the developing units 22Y, 22M, 22C, and 22K include developing rollers 23Y, 23M, 23C, and 23K as developer bearers to supply the photoconductors 3Y, 3M, 3C, and 3K with toner T, and supply rollers 24Y, 24M, 24C, and 24K as supply members to supply the developing rollers 23Y, 23M, 23C, and 23K with the toner K, respectively. The supply rollers 24Y, 24M, 24C, and 24K are collectively referred to as a supply roller 24 in some cases. The developing rollers 23Y, 23M, 23C, and 23K are collectively referred to as a developing roller 23 in some cases.

Each of the photoconductors 3Y, 3M, 3C, and 3K rotates at a peripheral speed V1 within a predetermined range. The surfaces 3*a* of the photoconductors 3Y, 3M, 3C, and 3K are uniformly charged by the charging rollers 21Y, 21M, 21C, and 21K, respectively. The charging unit may be a contact charging device that contacts each photoconductor (3Y, 3M, 3C, and 3K). Alternatively, a contactless charging device may be employed.

The uniformly charged surfaces 3*a* of the photoconductors 3Y, 3M, 3C, and 3K are scanned by light beams projected from optical writing head 7Y, 7M, 7C, and 7K, thereby forming electrostatic latent images for the respective colors. Then, the developing rollers 23Y, 23M 23C, and 23K of the developing units 22Y, 22M, 22C, and 22K supply the photoconductors 3Y, 3M, 3C, and 3K toner T for the respective colors, developing the latent images into toner images for the respective colors.

As illustrated in FIG. 3, an intermediate transfer device 30 includes a transfer belt 34 as a transfer member formed into an endless looped belt wound around and stretched taut about a drive roller 31 and a tension roller 32. The transfer belt 34 rotates in a direction of rotation indicated by arrow A in FIG. 3. Inside the loop of the transfer belt 34, primary transfer roller 33Y, 33M, 33C, and 33K as a plurality of transfer rotators, and a cleaning roller 38 are disposed.

The primary transfer rollers 33Y, 33M, 33C, and 33K are pressed against the inner surface of the transfer belt 34. The surfaces 3*a* of the photoconductors 3Y, 3M, 3C, and 3K opposed to the primary transfer rollers 33Y, 33M, 33C, and 33K contact the surface 34*a* of the transfer belt 34 to form primary transfer portions between the surfaces 3*a* and the surfaces 34*a*. The respective primary transfer rollers 33Y, 33C, 33M, and 33K receive a primary transfer bias applied. With the rotation of the drive roller 31, the primary transfer rollers 33Y, 33M, 33C, and 33K rotates with the transfer belt 34 rotating in the direction A of rotation.

Outside the loop of the transfer belt 34, a secondary transfer roller 35 is disposed facing the drive roller 31. The secondary transfer roller 35 contacts the transfer belt 34 to form a secondary transfer portion as the transfer portion. The secondary transfer roller 35 receives a secondary transfer bias applied. The toner images are primarily transferred from the photoconductors 3Y, 3M, 3C, and 3K onto the transfer belt 34 at the primary transfer portions. Then, the primarily transferred toner image is conveyed to the secondary transfer portion with the rotation of the transfer belt 34. In the present embodiment, the peripheral speed V1 of each of the photoconductors 3Y, 3M, 3C, and 3K differs from the peripheral speed V2 of the transfer belt 34 as the transfer member. Particularly, the peripheral speed V2 of the transfer belt 34 is faster than the peripheral speed V1 of each of the photoconductors 3Y, 3M, 3C, and 3K.

The sheet feeder 40 is disposed at the bottom of the apparatus body 10A, in which a plurality of recording sheets P are stacked and stored. The recording sheets P are conveyed through a vertical conveyance path. A registration roller 42 is disposed on the conveyance path, between the sheet feeder 40 and the secondary transfer portion. The sheet feeder 40 feeds a recording sheet P toward the registration roller 42, using a feed roller 41. The registration roller 42 sends the fed recording sheet P to the secondary transfer portion, to coincide with a toner image of the transfer belt 34 at secondary transfer portion. The toner image is then transferred onto the recording sheet P fed to the secondary transfer portion. The fixing device 60 is disposed downstream from the secondary transfer portion.

While the recording sheet P passes through the fixing device 60, the toner image is fixed on the recording sheet P with heat and pressure. Then, the recording sheet P having the toner image fixed onto at the fixing device 60 is discharged by ejection rollers 13 to a tray 14A on an upper face of the apparatus body 10A.

As illustrated in FIG. 3, the residual toner is removed from the transfer belt 34 by a belt cleaning blade 37, which contacts the surface of the transfer belt 34, within a belt cleaner 36. The removed toner residues are sent to and collected in a waste toner container 80. It is to be note that, cleaning type of the belt cleaner 36 is not limited to a blade type. Instead, an electrostatic type, such as an electrostatic brush type or an electrostatic roller type, is available. In the case of the electrostatic type, a cleaning brush or a roller is disposed instead.

There are some cases in which backup charge for the residual toner having not transferred is needed according to the status of use of the color image forming apparatus 1A. In such cases, the cleaner increases in size, and one to two high-voltage power sources are added. Accordingly, the belt cleaner 36 is preferably a belt blade type from the viewpoints of reduction in size and cost as well as cleanability.

Next, a description is provided of the surroundings of each of the photoconductors 3Y, 3M, 3C, and 3K, and the intermediate transfer device 30.

Each of the photoconductors 3Y, 3M, 3C, and 3K is tubular with a diameter of 30 mm, and rotates at a peripheral speed ranging from 50 through 200 mm/S.

Each of the charging rollers 21Y, 21M, 21C, and 21K receives a bias of a direct current (DC) voltage or a bias, in which the DC voltage is superimposed on an alternating current (AC) voltage. In the present embodiments, each surface of the photoconductors 3Y, 3M, 3C, and 3K are uniformly charged to have a potential of −500 V.

In the present embodiments, with each surface of the photoconductors 3Y, 3M, 3C, and 3K exposed to light, the surface potential drops down to −50 V.

Each of the developing units 22Y, 22M, 22C, and 22K develops an electrostatic latent image of each of the photoconductors 3Y, 3M, 3C, and 3K with a bias of a predetermined value, such as −200 V, supplied from the high-voltage power source, into a visualized toner image. Each of the developing units 22Y, 22M, 22C, and 22K stores toner T having a negative charging polarity.

The process cartridges 2Y, 2M, 2C, and 2K and the drive roller 31 may be driven by the respective separate drive power sources or by a common power source. At least the process cartridge 2K for black and the drive roller 31 are typically turned on and off at the same time, using a common power source, which is preferable to achieve a reduction in size and cost.

Each of the primary transfer rollers 33Y, 33C, 33M, and 33K is a sponge roller, which is a foam roller with a diameter of 12 through 16 mm. Each of the primary transfer rollers 33Y, 33M, 33C, and 33K is an ion conductive roller (combination of urethane and carbon dispersion, ntrile-butadene rbber (NBR), epichlorhydrin rubber) or an electronically conductive roller (Ethylene Propylene Rubber (EPDM)) having a resistance value ranging from $10^6$ through $10^8$ Ω. Alternatively, in some embodiments, each of the primary transfer rollers 33Y, 33M, 33C, and 33K is a pure metal roller, which is advantageous from the viewpoint of costs. In such a case, instead of disposing each of the primary transfer roller 33Y, 33M, 33C, and 33K immediately below the center of each of the photoconductor 3Y, 3M, 3C, and 3K, respectively, each of the primary transfer roller 33Y, 33M, 33C, and 33K is offset in a downstream direction, thereby causing the transfer belt 34 to wound around each of the photoconductors 3Y, 3M, 3C, and 3K, thus resulting in a successful primary transfer.

As the materials for the transfer belt 34, an endless belt of a resin film is employed, in which conductive material, such as carbon black, is dispoersed in poly vinyldene fluoride (PVDF), ethylenetetrafluoroethylene (ETFE), polyimide (PI), polycarbonate (PC), and thermoplastic elastomer (TPE). In the present embodiment, a single-layer belt having a thickness ranging from 90 through 160 μm and a width of 230 mm is used, in which carbon black is added to the TPE with a tensile elasticity ranging from 1000 through 2000 MPa. The volume resistivity of the belt ranges from $10^8$ through $10^{11}$ Ωcm and the surface resistivity of the belt ranges from $10^8$ through $10^{11}$ Ω/sq, which are measured with an applied voltage of 500 V for 10 seconds, Hiresta UPM-CPHT 45 manufactured by Mitsubishi Chemical Corporation.

The secondary transfer roller 35 is a sponge roller having a diameter of 16 through 25 mm. The secondary transfer roller 35 an ion conductive roller (combination of urethane and carbon dispersion, ntrile-butadene rbber (NBR), epichlorhydrin rubber) or an electronically conductive roller (Ethylene Propylene Rubber (EPDM)) having a resistance value ranging from $10^6$ through $10^8$ Ω. The resistance value of the secondary transfer roller 35 exceeding the upper limit described above makes it difficult for a sufficient amount of current to flow. Accordingly, a high voltage is applied to achieve a successful transfer, resulting in an increase in cost for power source. In addition, applying a high voltage to a transfer nip leads to the occurrence of electrical discharge in space in the vicinity of the transfer nip, thereby causing white spots to appear in a halftone image. Such a phenomenon is prominent under the environment conditions of low temperature and low humidity, for example at a temperature of 10° C. and a relative humidity (RH) of 15%. By contrast, the resistance value of the secondary transfer roller 35 falling below the lower limit described above hampers the transferability of both an image portion including a plurality of colors (hereinafter referred to as multi-color image portion) in a image, e.g., a three-color composite image, and a single-color image portion. This is because, a relatively low voltage is sufficient to perform a transfer in a single-color image portion with a sufficient amount of current flow. By contrast, to perform a successful transfer in a multi-color image portion, a higher voltage is applied than an appropriate amount of voltage for the single-color image portion. Accordingly, with an amount voltage appropriate for the multi-color image applied, an excessive amount of transfer current is applied to the single-color image portion, thus reducing the transfer efficiency.

It is to be noted that, the resistance value of each of the primary transfer roller 33Y, 33M, 33C, and 33K and the secondary transfer roller 35 is calculated from the value of current flown when a voltage of 1 kV is applied to between the metal core of each roller and a conductive metal plate, on which each roller is disposed. In this case, each core metal has a load of 4.9 N on both ends of the core metal.

The drive roller 31 may be made of polyurethane rubber with a thickness ranging from 0.3 through 1 mm, or may be a thin coated roller with a thickness ranging from 0.03 through 0.1 mm. In the present embodiment, the drive roller 31 is an urethane coated roller with a thickness of 0.05 mm and a diameter of 19 mm, which has a small change in diameter with changes in temperature. The electrical resistance value of the drive roller 31 is set less than $10^6$ Ω, which is lower than the resistance value of the secondary transfer roller 35.

There are two secondary transfer methods: One is an attraction transfer method, in which a bias having a positive polarity is applied to the secondary transfer roller 35 and the drive roller 31 is electrically grounded to form a secondary transfer electrical field. The other is a repulsive force transfer method, in which a bias having a negative polarity is applied to the drive roller 31 and the secondary transfer roller 35 is electrically grounded to form a secondary transfer electrical field. In the present embodiment, the repulsive force transfer method is employed, in which a transfer bias ranging from +5 through 100 μA is applied under a constant current control when a recording sheet P passes through a nip.

In the present embodiment, a speed of image formation process changes according to the type of the recording sheet P. Particularly, with a recording sheet P having a sheet basis weight of greater than 100 g/$m^2$, the image formation process slows down to a half speed. Accordingly, the recording sheet P passes through a fixing nip formed by a fixing roller pair in the fixing device 60, taking twice time longer than the normal speed of the image formation process, thereby ensuring the fixing property of a tone image.

Next, a description is provided of toner T used in the present embodiments.

First Polyester

Initially, a first polyester is synthesized as described below. Into a reactor vessel to which a cooling pipe, an agitator, and a nitrogen introduction pipe are attached, 235 parts of bisphenol A-ethylene oxide-2-mole appendix, 525 parts of bisphenol A-propylene oxide 3-mole appendix, 205 parts of terephthalic acid, 47 parts of adipic acid, and 2 parts of jibtylchin oxide are input. Then, eight hours of chemical reaction is performed under ordinary pressure and room temperature of about 230 degrees Celsius. Subsequently, five hours of chemical reaction is performed under decreased pressure of from about 10 mmHg to about 15 mmHg. After that, 46 parts of anhydrotrimellic acid is input into the reactor vessel and chemical reaction is performed for two hours under ordinary pressure and room temperature of about 180 degrees Celsius, so that the first polyester is obtained. The first Polyester includes a number average molecular weight of 2,600, a weight average molecular weight of 6,900,a glass transition point Tg of about 44 degrees Celsius, and an acid value of 26.

Synthesis of First Prepolymer

Next, a first prepolymer is synthesized as described below. Into a reactor vessel, to which a cooling pipe, an agitator, and a nitrogen introduction pipe are attached, 682 parts of bisphenol A-ethylene oxide-2-mole appendix, 81 parts of bisphenol A-propylene oxide 2-mole appendix, 283 parts of terephthalic acid, 22 parts of anhydrotrimellic acid, and 2 parts of jibtylchin oxide are input. Then, eight hours of chemical reaction is performed under ordinary pressure and room temperature of about 230 degrees Celsius. Subsequently, five hours of chemical reaction is performed under decreased pressure of from about 10 mmHg to about 15 mmHg, so that a first intermediate Polyester is obtained. Here, the first intermediate Polyester includes the number average molecular weight of about 2,100, a weight average molecular weight of about 9,500, a glass transition point Tg of about 55 degrees Celsius, an acid value of about 0.5,and a hydroxyl group number of about 49. Subsequently, into a reactor vessel, to which a cooling pipe, an agitator, and a nitrogen introduction pipe are attached, 411 parts of the first intermediate polyester, 89 parts of isophorone diisocyanate, and 500 parts of ethyl ester are input. Then, five hours of chemical reaction is performed in room temperature of about 100 degrees Celsius so that the first prepolymer is obtained. Here, a free isocyanate weight % of the first prepolymer is about 1.53%.

Production of First Master Batch

Now, a first master batch is produced as described below. Forty parts of carbon black (Regal 400R manufactured by Cabot Corp.,), 60 parts of polyester resin as binder resin (RS-801 manufactured by Sanyo Chemical having an acid value 10, an Mw (weight average molecular weight) of 20,000, and a Tg (grass transition point) of 64 degrees Celsius), and 30 parts of water are mixed by Henschel mixer, so that a mixture in which water is infiltrated into the pigment aggregation is obtained. Then, the mixture is kneaded for 45 minutes by a pair of rolls having a surface temperature set to about 130 degrees Celsius, and is crushed by a pulverizer into grains each having a size of about 1 mm, so that a first master batch is obtained.

Production of First Pigments and Wax Dispersion Solution (Oil Phase)

Now, a first pigments and wax dispersion solution (oil phase) is produced as described below. Into a vessel, to which a stirring rod and a thermometer are set, 545 parts of first polyester, 181 parts of paraffin wax, and 1,450 parts of ethyl acetate are input and stirred while warming them up to about 80 degrees Celsius for about 5 hours. Then, the mixture is cooled down to about 30 degrees Celsius within one hour. Subsequently, 500 parts of a first master batch, 100 parts of a first electric charge control agents, and 100 parts of ethyl acetate are input into the vessel. Such preparation is then mixed for 1 hour, so that a first raw material solution is obtained.

First Raw Material Solution Liquid

Then, 1500 parts of the first raw material solution liquid is poured into a vessel, and carbon black and wax are dispersed therein by using a bead mill (e.g. Ultra-visco mill manufactured by AIMEX Co., Ltd.) under conditions in that a solution sending speed is about 1 kg/hr, a disk peripheral speed is about 6 m/s, and an amount of 80 cubic volume % of zirconia beads of 0.5 mm is filled, and the number of passage times is about three. Next, 425 and 230 parts of the first polyester are added to the mixture and are collectively passed through the bead mill once under the above-described conditions thereof, so that the first pigment and wax dispersion solution is obtained. Then, the first pigment and wax dispersion solution is regulated so that a solid content thereof becomes about 50% (about 130 degrees Celsius, about 30 minutes).

Aqueous Phase Preparing Process

Then, an aqueous phase preparing process is executed as described below. Specifically, 970 parts of ion exchange water, 40 parts of 25 wt % aqueous dispersion liquid of dispersion stabling fine organic resin particles (e.g., copolymers of sodium salt of styrene-methacrylate-butyl acrylate-methacrylate ethylene oxide added sulfate), and 140 parts and 90 parts of 48.5% solution of dodecyl diphenyl ether disulfonic acid sodium (e.g., Eleminol MON-7 produced by Sanyo Chemical Industries, Ltd.) are mixed and stirred, so that milky-white liquid is obtained as a first aqueous phase.

Emulsification Process

First Pigments and Wax Dispersion Solution

Then, an emulsification process is executed as described below. First, 975 parts of the first pigments and wax dispersion solution and 2.6 parts of isophoronediamine are mixed by a TK homo mixer (manufactured by PRIMIX Corporation) at about 5,000 rpm for about 1 minute. Then, 88 parts of the first prepolymer is added to the mixture and are further collectively mixed by the TK homo mixer at about 5,000 rpm for about 1 minute. Then, 1200 parts of the first aqueous phase of the milky-white liquid is added to the mixture and further mixed by the TK homo mixer at the number of rotations of from about 8,000 rpm to about 13,000 rpm for about 20 minutes, so that a first emulsion slurry is obtained.

Solvent Free Process

Now, a solvent free process is executed as described below. Into a container provided with an agitator and a thermometer, a first emulsion slurry is input and a solvent free process is performed at about 30 degrees Celsius for about eight hours, so that a first dispersed slurry is obtained.

Washing and Drying Processes

First Distributed Slurry

Now, washing and drying processes are performed as described below. After filtration of 1000 parts of the first distributed slurry under decreased pressure, the following processes are executed. First, 100 parts of ion exchange water is added to a filter cake, and are mixed by the TK HOMOMIXER (for about 10 minutes at the number of rotations of about 12,000 (rpm)), and are then subjected to filtration to obtain a filtrate. At this moment, the filtrate is creamy-white. Secondly, to the above-described filter cake, 900 parts of ion exchange water is added and mixed therewith by the TK HOMOMIXER while applying ultrasonic vibration thereto (for about 30 minutes at the number of rotations of about 12,000 rpm (revolutions per minute)). The mixture is then subjected to filtration under decreased pressure. This operation is repeated so that (until) electric conductivity of the reslurry fluid becomes about 10 μC/cm or less. Thirdly, 10% hydrochloric acid is added so that pH (hydrogen power) of the above-described reslurry liquid becomes about 4,and is stirred therewith by a three-one motor (i.e., a mixing motor) for about 30 minutes. The mixture is then filtered. Fourthly, to the above-described filter cake, 100 parts of ion exchange water is added and is mixed therewith by the TK HOMOMIXER (at a number of rotations of about 12,000 (rpm) for about 10 minutes). Then, the mixture is subjected to a filtrate process thereafter. The above-described operation is repeated so that (until) electric conductivity of the reslurry liquid becomes about 10 μC/cm or less, so that a first filtration cake is obtained. Then, the first filtration cake is dried at about 42 degrees Celsius for about 48 hours in an ambient wind drying machine, and is sieved by a mesh having of an opening about 75 μm, so that mother toner is obtained. Specifically, the mother toner includes an average circular degree of about 0.974,a volume average grain size (Dv) of about 6.3 μm, a number average particle size (Dp) of about 5.3 μm, and a particle size distribution Dv/Dp of about 1.19.

To 100 parts of the mother toner obtained by the above-described process, 1 part of commercially available fine silica powder H20TM [manufactured by Clariant Japan Corp., with a mean primary particle size of about 12 nm not processed by silicone oil], and 2 parts of RY50 [ manufactured by Japan Aerosil Corp., having a mean primary particle size of about 40 nm processed by silicone oil] are mixed by the Henschel mixer. Then, by letting the mixture pass through a sieve having an opening about 60 μm and thereby removing coarse particles and aggregates, toner is obtained.

Figure 5:
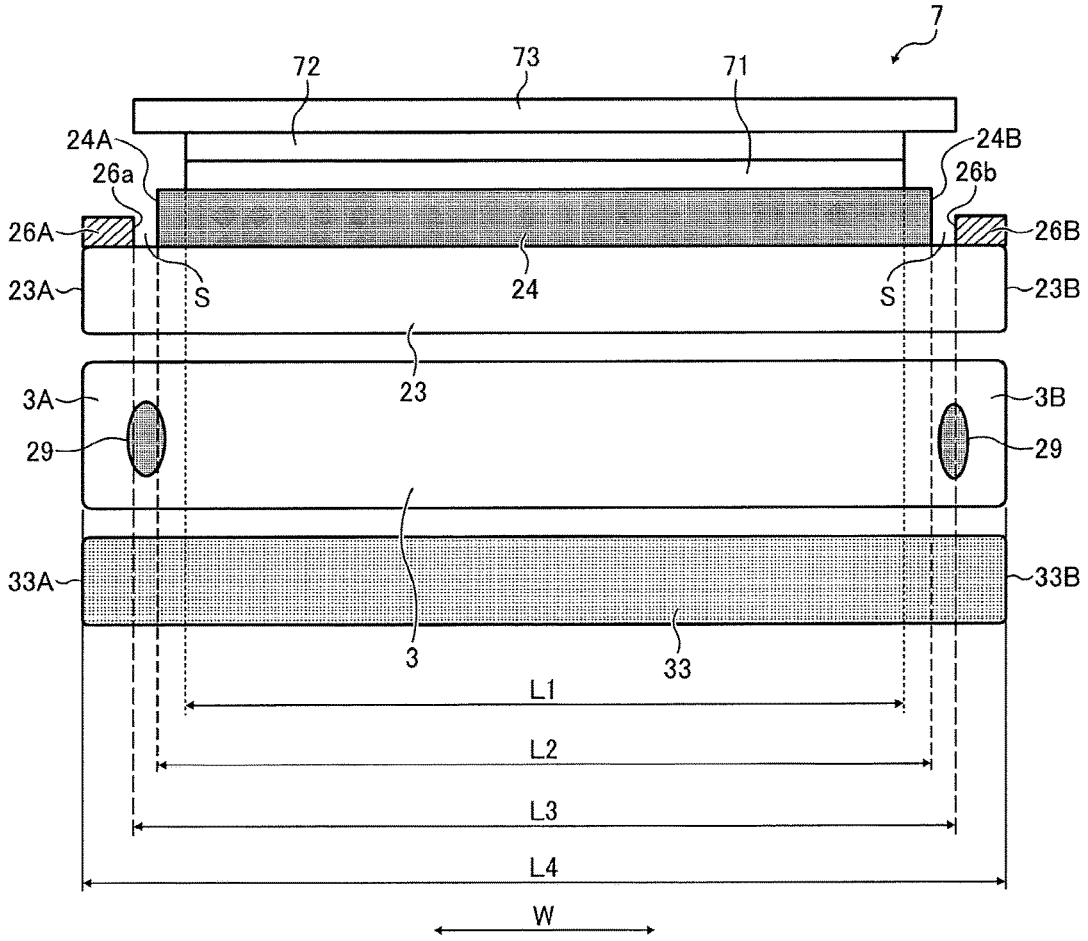
FIG. 5 is a diagram describing the relative positions of a supply member and a transfer member according to a comparative example.

FIG. 5 is a diagram of an arrangement of components in the direction W of axis in a process cartridge according to a comparative example. In this case, the photoconductor 3Y, 3M, 3C, and 3K are collectively referred to as a photoconductor 3. The optical writing head 7 includes a light emitting substrate, a lens array 72, and a head frame holding the lens array 72. Further, the supply rollers 24Y, 24M, 24C, and 24K are collectively referred to as a supply roller 24. The transfer rollers 33Y, 33M, 33C, and 33K are collectively referred to as a transfer roller 33. The charging roller 21Y, 21M, 21C, and 21*k* are also collectively referred to as a charging roller 21. As illustrated in FIG. 5, the optical writing head 7 extends along the direction W of axis of the photoconductor 3. In the present embodiments, the width L1 of the lens array 72 in the direction W of axis is also referred to as the width L1 of an image area.

In the present embodiments, the reference numeral "L2" denotes the width of the supply roller 24 in the direction W of axis. The supply roller 24 supplies the developing roller 23 with toner T. The width L2 corresponds to the length between a first end 24A and a second end 24B of the supply roller 24.

The developing roller 23 has a first seal 26A and a second seal 26B at the respective end 23A and end 23B of the developing roller 23 in the direction W of axis, respectively to prevent leaks of toner from the ends 23A and 23B. Each of the first seal 26A and the second seal 26B is made of felt material. In the present embodiments, the reference numeral "L3" in FIG. 5 denotes the width of a thin toner layer, which is the distance between the first inner surface 26*a* of the first seal 26A and the second inner surface 26*b* of the second seal 26B. Within the width L3 of the thin toner layer, a thin layer of toner T is disposed over the surface of the developing roller 23. In the present embodiments, the reference numeral "L4" denotes the width in the direction W of axis of the transfer roller 33 contacting the photoconductor 3. The width L4 corresponds to the length between the ends 33A and 33B of the transfer roller 33.

Figure 4B:
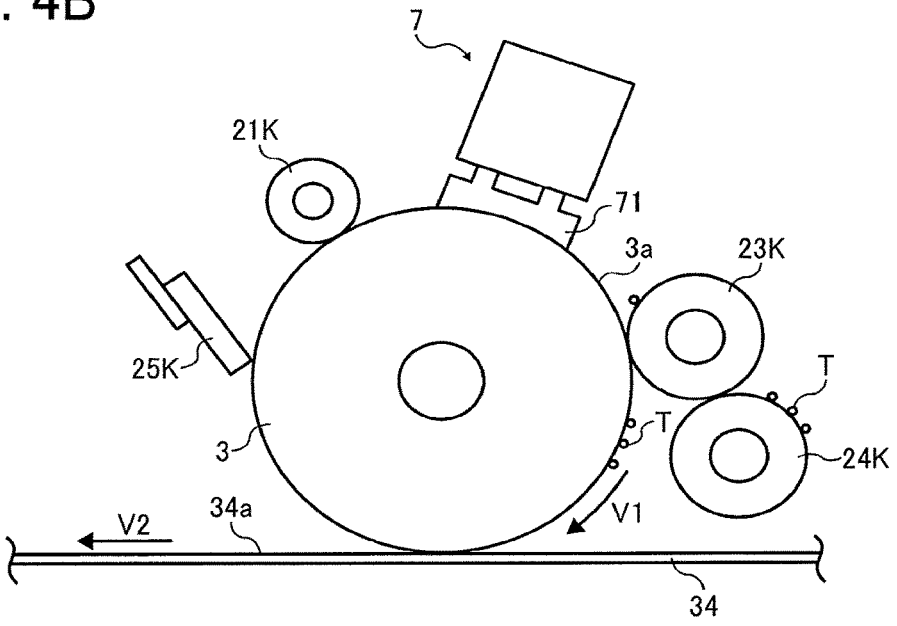

In the configuration according to a comparative example, the width L4 of the transfer roller 33, the width L3 of the thin toner layer, and the width L2 of the supply roller 24 satisfy the relations of L4>L3>L2. In this case, an external additive aggregation 29, which is also referred to as "killfish", appears in the first inner surface 26*a* and second inner surface 26*b* of the first seal 26A and the second seal 26B or between the first end 24A of the supply roller 24 and the first seal 26A and between the second end 24B and the second seal 26B. When the cleaning blade 25 illustrated in FIGS. 2 and 4 is damaged, a toner streak is formed on the photoconductor 3, which is scraped by the transfer roller 33, resulting in toner T scattering within the apparatus. The scattered toner T adheres to a conveyance path, which may contaminate the back surface or the edge surface of the recording sheet P.

When silica is used for the external additive of the toner T, there is a case that silica separates from toner due to friction between toner. Silica separated from toner is likely to deposit on both ends 23A and 23B of the developing roller 23, or on space S between the first seal 26A and the supply roller 24 and between the second seal 26B and the supply roller 24. Such silica is developed into an external additive aggregation 29 (killfish) on the photoconductor 3 during the developing process. With an increase in size of the external additive aggregation 29, the edge of the cleaning blade 25 may be damaged, thereby causing toner to leak out of the damaged part, contaminating the charging roller 21 as a charger, resulting in scattering of toner because the surface of the photoconductor 3 corresponding to a contaminated position on the charging roller 21 is not charged.

With a configuration, in which both ends 24A and 24B of the supply roller 24 contact the first seal 26A and the second 26B, respectively, no space S is formed between the first end 24A and the first seals 26A and between the second end 24B and the second seal 26B. In such a configuration as well, toner T moving along the developing roller 23 is likely to accumulate in the ends 23A and 23B. Further, the first seal 26A and the second seal 26B contacting the first end 24A and the second end 24B of the supply roller 24, respectively results in poor convection of toner and friction of toner between each other, thereby separating silica from toner.

(Embodiment 1)

Figure 6:
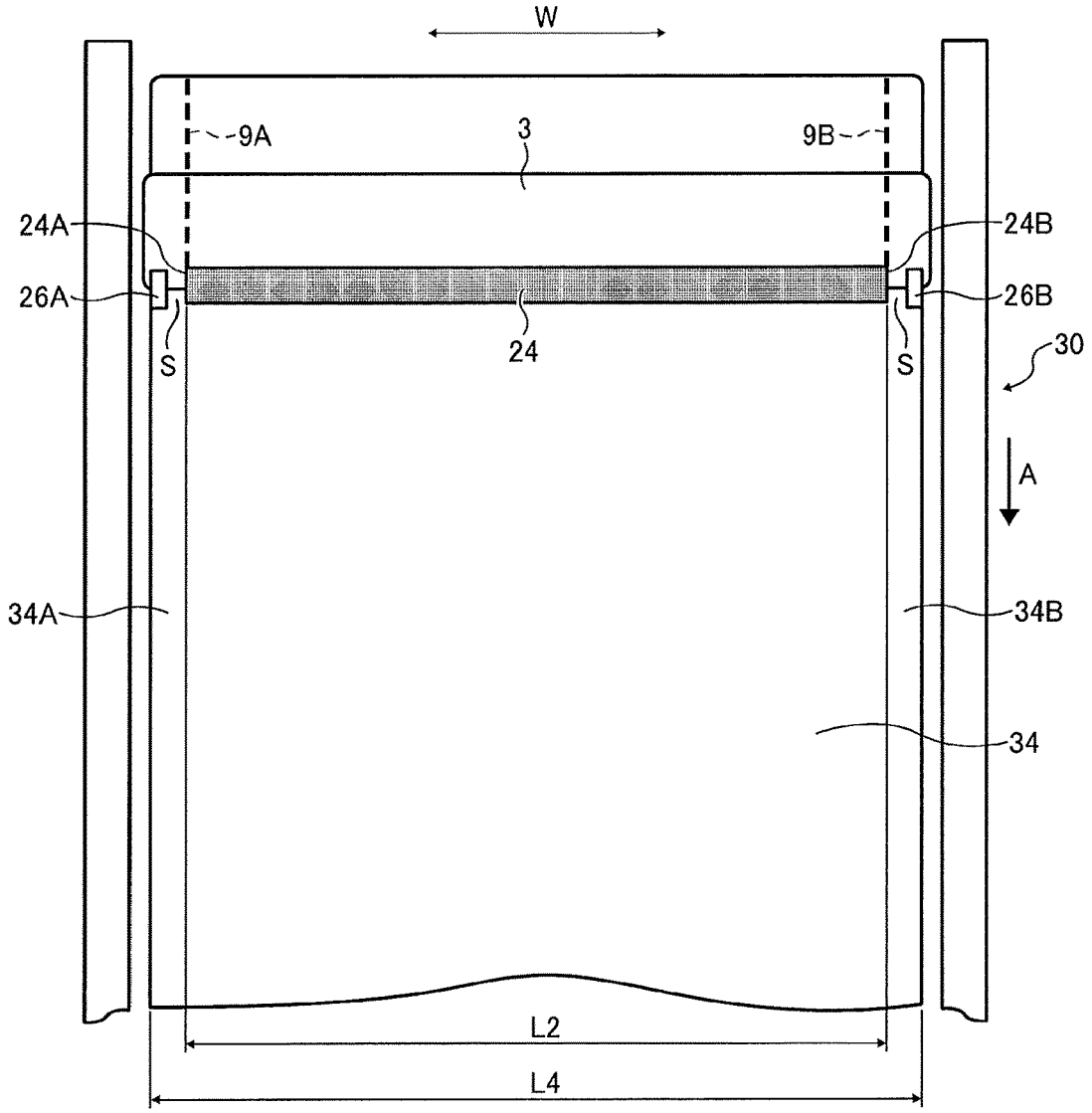
FIG. 6 is a diagram describing the relative positions of a supply member and a belt-shaped transfer member according to an embodiment of the present disclosure.

In the present embodiment, a configuration is provided that prevents toner scattering due to an external additive aggregation 29 in a process cartridge 2 as illustrated in FIG. 1. That is, in FIG. 1, the width L4 of a transfer roller 33, the width L2 of a supply roller 24, and the width L3 of a thin toner layer satisfy the relations of L4<L2<L3. With such relations satisfied, the external additive aggregation 29 formed on the photoconductor 3 is prevented from contacting the ends 33A and 33B of the transfer roller 33 while preventing the toner streak due to the transfer roller 33 from contacting the transfer roller 33. As a result, no toner scattering occurs. In the configuration of the color image forming apparatus 1A as illustrated in FIG. 3, as illustrated in FIG. 6, toner streaks 9A and 9B indicated by broken lines are transferred from the photoconductor 3 onto the ends 34A and 34B of the transfer belt 34, and then scatters due to the rotation of the transfer belt 34, thus contaminating the interior of the apparatus. Accordingly, in this case, the width L4 refers to the width of an endless transfer belt 34, instead of the width of the transfer roller 33. That is, the width L4 of the transfer belt 34, the width L2 of the supply roller 24, and the width L3 of the thin toner layer satisfy the relations of L4<L2<L3. With this configuration, the toner streaks 9A and 9B on the photoconductor 3, which are generated by the external additive aggregation 29, do not contact the transfer belt 34. As a result, no toner scattering occurs due to the rotation of the transfer belt 34, preventing the interior of the apparatus from being contaminated.

(Embodiment 2)

Figure 7:
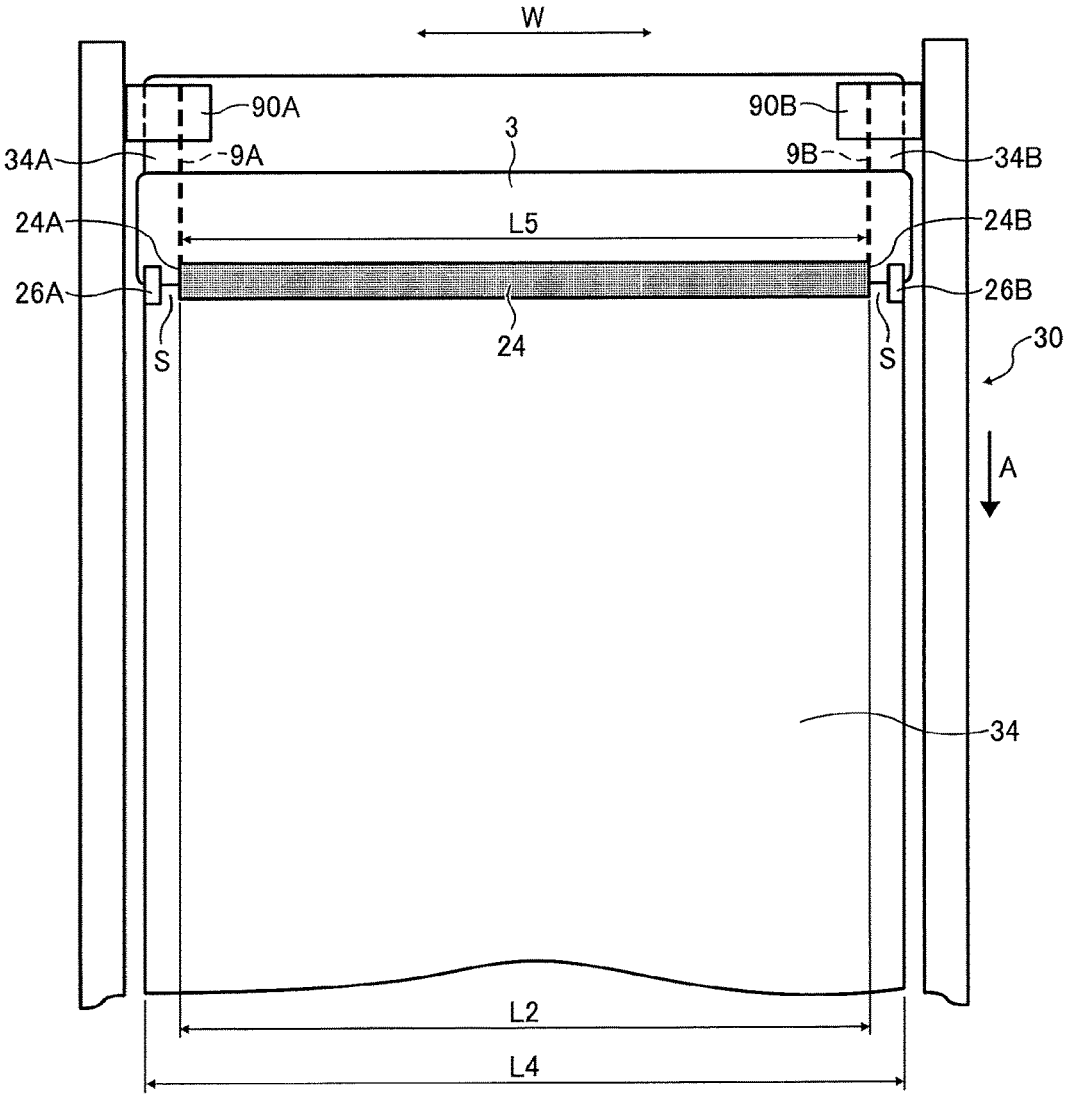
FIG. 7 is a diagram describing a configuration with a belt presser.

As illustrated in FIG. 7, an intermediate transfer device 30 includes belt pressers 90A and 90B (pressing members) to press the ends 34A and 34B of the transfer belt 34 in width direction W perpendicular to the direction A of rotation of the transfer belt 34 formed into an endless loop. It is to be noted that the width direction W is the direction of axis as well.

With the belt pressers 90A and 90B, the external additive aggregation 20 generated on the ends 24A and 24B of the supply roller 24 damages the cleaning blade 25, thereby causing the toner streaks 9A and 9B indicated by broken lines in FIG. 7 to contact the belt pressers 90A and 90B, resulting in scattering of toner T in the interior of the apparatus. Further, with the belt pressers 90A and 90B, toner T goes to the back surface of the transfer belt 34, and the toner T may drop onto the recording sheet P within the sheet feeder 40 disposed below the transfer belt 34 as illustrated in FIG. 3.

Figure 8:
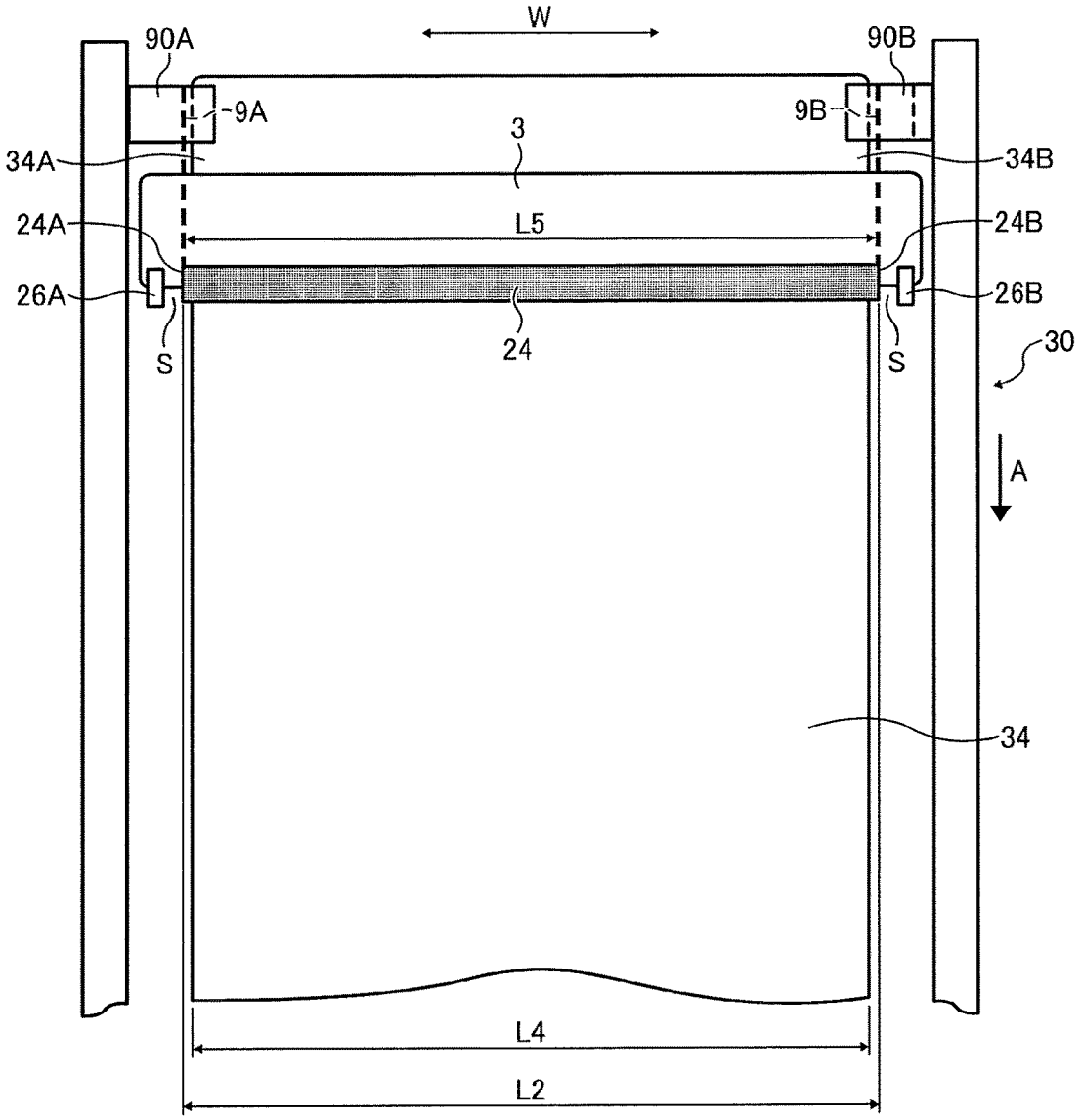
FIG. 8 is a diagram describing the relative positions of a supply member and a transfer member with the belt presser according to a second embodiment of the present disclosure.

Considering the circumstances described above, as illustrated in FIG. 8, the width L4 of the transfer belt 34 in the width direction W is set to be smaller than the width L2 of the supply roller 24, preferably than the width L5 of between the toner streaks 9A and 9B generated in the ends 24A and 24B, respectively of the supply roller 24. With this configuration, both of the ends 34A and 34B of the transfer belt 34 are positioned within the width L5.

With such a configuration, the toner streaks 9A and 9B are prevented from overlapping the ends 34A and 34B of the transfer belt 34, thus preventing the toner streaks 9A and 9B from being transferred onto the transfer belt 34, resulting in eliminating or reducing the toner scattering.

Figure 9:
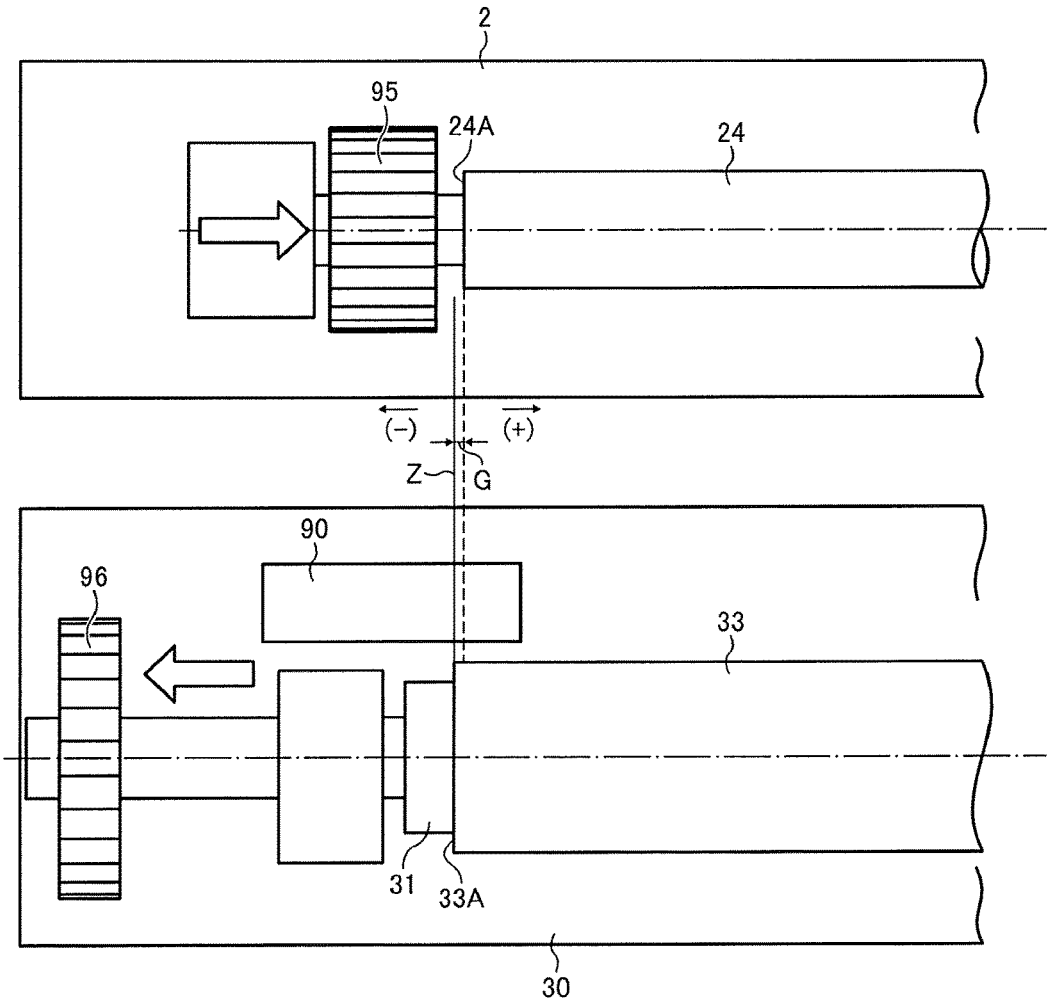
FIG. 9 is an enlarged view of a space between an end of the belt-shaped transfer member and an end of the supply member.

Next, an observation is given of how much degree the ends 34A and 34B of the transfer belt 34 are positioned inward within the width L2 of the supply roller 24, and how much degree the ends 33A and 33B of the transfer roller 33 are positioned inward within the width L2 of the supply roller 24, referring to FIG. 9.

With the width L4 of the transfer belt 34 or the transfer roller 33 longer than the width L1 of an image area, the ends 34A and 34B of the transfer belt 34 and the ends 33A and 33B of the transfer roller 33 are preferably positioned within the width L2 of the supply roller 24 as much as possible. Even with the fluctuations in width of the external additive aggregation 29 or with the movement of the transfer belt 34 or the transfer roller 33 in the direction of axis (width direction W) due to clearance, such a configuration prevents the ends 34A and 34B of the transfer belt 34 and the ends 33A and 33B of the transfer roller 33 from being interfered with by the deposited external additive aggregation 29 and toner streaks 9A and 9B.

FIG. 9 is an illustration of a gap G between the first end 24A of the supply roller 24 and the end 33A of the transfer roller 33. Preferably, the gap G is set to a value based on a dimensional tolerance regarding a gap between the supply roller 24 and the transfer belt 34, not the clearance for the supply roller 24 itself because tolerances of the developing unit 22 of the process cartridge 2, the intermediate transfer device 30, and the apparatus body 10A are cumulated.

In FIG. 9, the gap between the first end 24A of the supply roller 24 and the end 33A of the transfer roller 33 is 0.6±1.3 mm. In this case, the direction to right is "+", and the direction to left is "−" with respect to line Z in FIG. 9. Line Z lies on the left side of the overlapping portion of the supply roller 24 and the transfer roller 33.

The supply roller 24 is drawn to the side of the end 24B (non-drive side) opposite to the side of the end 24A with a roller drive gear 95. The transfer roller 33 is drawn to the side of the end 33A with a roller drive gear 96.

The assembly clearance of the intermediate transfer unit and the process cartridge 2 may be set in outline.

That is, the ends 34A and 34B of the transfer belt 34 and the ends 33A and 33B may be positioned inwardly only by the range of 0.6±1.3 mm from the first end 24A and the second end 24B of the supply roller 24, respectively. Positioning the ends 34A and 34B of the transfer belt 34 and the ends 33A and 33B of the transfer roller 33 within the range allows disposition of the transfer belt 34 and the transfer roller 33 within the range of the width of L2 even with the fluctuations in assembly and the clearance of the transfer belt 34 and the transfer roller 33 in the direction W of axis.

In the embodiment described above, the first end 24A and the second end 24B of the supply roller 24 do not contact the first seal 26A and the second seal 26B, respectively, to form space S. In some embodiments, the first seal 26A and the second seal 26B contact the first end 24A and the second end 24B of the supply roller 24, respectively. With such a configuration, in which the first seal 26A and the second seal 26B contact the first end 24A and the second end 24B, respectively, the first seal 26A and the second seal 26B may be removed during the operation. Accordingly, the first seal 26A and the second 26B are preferably made of fluorine materials. Alternatively, highly-slidable nylon washer may be installed in the first end 24A and the second end 24B of the supply roller 24, which prevents the first seal 26A and the second seal 26B from directly contacting both ends 24A and 24B of the supply roller 24. Examples of nylon washer include nylon washer manufactured by ASAHI POLY-SLIDER COMPANY, LIMITED.

In the embodiments described above, each developing roller 23 contacts each photoconductor 3, thereby increasing a pressure between the developing roller 23 and the photoconductor 3, resulting in an external additive aggregation 29 easily occurring on the photoconductor 3. However, shortening the width L4 of the transfer belt 34 or the transfer roller 33 compared to the width L2 of the supply roller 24 in the direction of axis eliminates or reduces scattering of toner.

In the embodiments described above, each of the primary transfer roller 33Y, 33M, 33C, and 33K is made of a sponge roller, which is a foamed roller, each having an unevenness surface with a micro-cell structure. Accordingly, when the external additive aggregation 29 occurs, toner is more likely to scatter. However, shortening the width L4 of the transfer belt 34 or the transfer roller 33 compared to the width L2 of the supply roller 24 in the direction of axis eliminates or reduces scattering of toner.

In the embodiments described above, the peripheral speed V1 of each of the photoconductors 3Y, 3M, 3C, and 3K differs from the peripheral speed V2 of the transfer belt 34 and the transfer roller 33, thereby preventing toner dropouts in an image during the transfer from the photoconductors 3Y, 3M, 3C, and 3K.

Although the embodiments of the present disclosure have been described above, the present disclosure is not limited to the embodiments described above, but a variety of modifications can naturally be made within the scope of the present disclosure.

The image forming apparatus 1/1A of the present disclosure is not limited to a color copier and a printer. The image forming apparatus 1/1A includes, but is not limited to, an electrophotographic facsimile machine or a multi-functional system including at least two of a copier, a printer, a facsimile machine, and so forth.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image bearer to bear toner;

a developer bearer including a first seal on one end of the developer bearer in a direction of axis of the developer bearer and a second seal on another end of the developer bearer in the direction of axis of the developer bearer, to supply the image bearer with the toner;

a supply member disposed within a range between the first seal and the second seal in the direction of axis of the developer bearer, to supply the developer bearer with the toner, a width of the supply member extending between outer edges of the supply member; and a transfer member opposed to the image bearer, the transfer member having a width between outer edges thereof shorter than the width of the supply member in the direction of axis of the developer bearer, the transfer member disposed within a range between the outer edges of the supply member in the direction of axis of the developer bearer, and the width of the transfer member is shorter than a supply width of the supply member over which the supply member supplies the toner to the developer bearer.

2. The image forming apparatus according to claim 1, wherein the developer bearer is in contact with a surface of the image bearer.

3. The image forming apparatus according to claim 1, wherein the transfer member is a foamed roller.

4. The image forming apparatus according to claim 1, wherein the transfer member is an endless belt.

5. The image forming apparatus according to claim 4, further comprising a plurality of pressing members to press each end of the transfer member in a width direction perpendicular to a direction of rotation of the transfer member.

6. The image forming apparatus according to claim 1, wherein the image bearer and the transfer member are rotatable, and wherein a peripheral speed of the image bearer differs from a peripheral speed of the transfer member.

7. The image forming apparatus according to claim 1, wherein:

a contact portion of the supply member which is a portion of the supply member that contacts the developer bearer is within the range between the first seal and the second seal in the direction of axis of the developer bearer.

* * * * *